US010741916B2

(12) United States Patent
Li et al.

(10) Patent No.: US 10,741,916 B2
(45) Date of Patent: Aug. 11, 2020

(54) METAL FRAME ANTENNA AND TERMINAL DEVICE

(71) Applicant: Huawei Technologies Co., Ltd., Shenzhen (CN)

(72) Inventors: Yuanpeng Li, Beijing (CN); Yafang Yu, Beijing (CN); Dawei Zhou, Beijing (CN); Hanyang Wang, Reading (GB); Kun Feng, Shanghai (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 246 days.

(21) Appl. No.: 15/781,015

(22) PCT Filed: Dec. 3, 2015

(86) PCT No.: PCT/CN2015/096311
§ 371 (c)(1),
(2) Date: Jun. 1, 2018

(87) PCT Pub. No.: WO2017/092003
PCT Pub. Date: Jun. 8, 2017

(65) Prior Publication Data

US 2018/0358699 A1 Dec. 13, 2018

(51) Int. Cl.

| | |
|---|---|
| ***H01Q 5/371*** | (2015.01) |
| ***H01Q 1/24*** | (2006.01) |
| ***H01Q 1/52*** | (2006.01) |
| ***H01Q 11/14*** | (2006.01) |
| ***H01Q 5/378*** | (2015.01) |

(Continued)

(52) U.S. Cl.
CPC ..... *H01Q 5/371* (2015.01); *H01Q 1/242* (2013.01); *H01Q 1/243* (2013.01); *H01Q 1/521* (2013.01); *H01Q 5/35* (2015.01); *H01Q 5/378* (2015.01); *H01Q 5/385* (2015.01); *H01Q 9/42* (2013.01); *H01Q 11/14* (2013.01)

(58) Field of Classification Search
CPC ..... H01Q 1/243; H01Q 9/42; H01Q 5/35; H01Q 5/378; H01Q 11/14; H01Q 5/371; H01Q 1/242; H01Q 1/521; H01Q 5/385
See application file for complete search history.

(56) References Cited

U.S. PATENT DOCUMENTS

| | | | | |
|---|---|---|---|---|
| 2012/0009983 A1* | 1/2012 | Mow | ..... | H01Q 7/005 455/575.7 |
| 2012/0229347 A1* | 9/2012 | Jin | ..... | H01Q 1/243 343/702 |

(Continued)

FOREIGN PATENT DOCUMENTS

| | | |
|---|---|---|
| CN | 103390793 A | 11/2013 |
| CN | 203536554 U | 4/2014 |

(Continued)

*Primary Examiner* — Graham P Smith
*Assistant Examiner* — Jae K Kim
(74) *Attorney, Agent, or Firm* — Slater Matsil, LLP

(57) ABSTRACT

A metal frame antenna and a terminal device are provided. The metal frame antenna includes N metal radiating elements between N+1 gaps, an end part of a metal radiating element on at least one of two sides of each of N−1 gaps between the N metal radiating elements is connected to a grounding part, the N metal radiating elements and respectively connected feeding branch circuits and grounding pails form N antennas, and N is an integer not less than 3.

17 Claims, 4 Drawing Sheets

(51) Int. Cl.

| | |
|---|---|
| ***H01Q 5/385*** | (2015.01) |
| ***H01Q 9/42*** | (2006.01) |
| ***H01Q 5/35*** | (2015.01) |

(56) References Cited

U.S. PATENT DOCUMENTS

| | | | | |
|---|---|---|---|---|
| 2013/0027254 | A1* | 1/2013 | Korva | H01Q 9/30 343/702 |
| 2013/0135150 | A1* | 5/2013 | Kenoun | H01Q 9/0421 343/700 MS |
| 2013/0201067 | A1 | 8/2013 | Hu et al. | |
| 2015/0147984 | A1* | 5/2015 | Ying | H04B 1/3827 455/90.3 |
| 2015/0155616 | A1* | 6/2015 | Lin | H01Q 1/243 343/702 |
| 2015/0188213 | A1* | 7/2015 | Lin | H01Q 1/243 343/702 |
| 2015/0207211 | A1* | 7/2015 | Martiskainen | H01Q 21/30 343/702 |
| 2015/0372372 | A1* | 12/2015 | Lee | H01Q 1/243 343/702 |
| 2016/0233574 | A1 | 8/2016 | Xiong et al. | |

FOREIGN PATENT DOCUMENTS

| | | | |
|---|---|---|---|
| CN | 104022349 | A | 9/2014 |
| CN | 104103888 | A | 10/2014 |
| CN | 104221215 | A | 12/2014 |
| CN | 104577334 | A | 4/2015 |
| CN | 204538197 | U | 8/2015 |
| JP | 2013211797 | A | 10/2013 |

* cited by examiner

METAL FRAME ANTENNA AND TERMINAL DEVICE

CROSS-REFERENCE TO RELATED APPLICATIONS

This application is a National Stage of International Patent Application No. PCT/CN2015/096311 filed on Dec. 3, 2015, which is hereby incorporated by reference in its entirety.

TECHNICAL FIELD

Embodiments of the present invention relate to antenna technologies, and in particular, to a metal frame antenna and a terminal device.

BACKGROUND

With rapid development of a mobile terminal technology, a mobile terminal device such as a mobile phone or a tablet computer generally has multiple wireless communication capabilities such as cellular communication, Wireless Fidelity (WiFi) communication, and Bluetooth communication. Therefore, multiple antennas or an antenna with multiple resonance frequencies needs to be configured for the mobile terminal device, so as to cover multiple frequency bands for wireless communication.

Currently, to meet a requirement of people for a simple and thin appearance of a mobile terminal device, an antenna of the mobile terminal device is generally disposed inside the device, and a plastic housing is generally used, for example, a housing with polycarbonate (PC) plastic and acrylonitrile butadiene styrene (ABS) plastic. However, because a metal housing is not only fashionable and textured, but also has excellent features such as better durability, a good heat-conducting property, and a long life span, people tend to purchase a mobile terminal device with a metal housing and a metal frame. Therefore, the mobile terminal device with a metal housing and a metal frame is more popular.

However, under a design trend towards a simple and thin mobile terminal device, net space that can be used by an antenna is increasingly limited, and an operating environment of the antenna becomes worse. In addition, a metal housing and a metal frame of the mobile terminal device shield an electromagnetic wave transmitted or received by the antenna in the mobile terminal device. Consequently, communication performance of the mobile terminal device is affected, and antenna utilization is low.

SUMMARY

Embodiments of the present invention provide a metal frame antenna and a terminal device. In a solution in which a multiple-input multiple-output metal frame antenna is disposed on a metal frame of a terminal device as a terminal device antenna, high antenna utilization of the terminal device with a whole metal housing is ensured, and relatively high isolation between adjacent antennas is further ensured.

A first aspect provides a metal frame antenna. The antenna includes a metal frame of a terminal device and N feeding branch circuits, where N is an integer not less than 3. N+1 gaps are disposed on the metal frame, and metal frames between the N+1 gaps form N metal radiating elements. The N metal radiating elements are respectively connected to the N feeding branch circuits. The N metal radiating elements are further respectively connected to grounding parts. The N metal radiating elements and the respectively connected feeding branch circuits and grounding parts form N antennas. At least one radiating path is formed in each antenna, and each radiating path has at least one resonance frequency. An end part of a metal radiating element on at least one of two sides of each of N−1 gaps between the N metal radiating elements is connected to a grounding part.

In the metal frame antenna provided in the first aspect, N+1 gaps are disposed on a metal frame of a terminal device, metal frames between the N+1 gaps form N metal radiating elements, and the N metal radiating elements are respectively connected to corresponding feeding branch circuits and corresponding grounding parts to form the metal frame antenna. An end part of a metal radiating element on at least one of two sides of each of N−1 gaps between the N metal radiating elements is connected to a grounding part. Therefore, multiple independent antennas are formed using metal frames of the terminal device, and feeding branch circuits and grounding parts of the antennas have relative location relationships, so that antenna communication performance of the terminal device is improved, antenna utilization is improved, and relatively high isolation between adjacent antennas is further ensured.

With reference to the first aspect, in a first possible implementation of the first aspect, the end part of the metal radiating element on the at least one of the two sides of each of the N−1 gaps between the N metal radiating elements is connected to the grounding part, so that isolation between two adjacent antennas is greater than a preset threshold. An end part of a metal radiating element on at least one of two sides of each of N−1 gaps between N metal radiating elements is connected to a grounding part, so that a feeding part of each antenna can form a resonance frequency only with a metal radiating element or a grounding part of the antenna. In a gap formed between two metal radiating elements, a current generated by a feeding part is absorbed by a grounding part located at an end part of a metal radiating element. Therefore, a current generated in each antenna does not interfere with a resonance frequency formed in another antenna, so as to ensure that isolation between two adjacent antennas is greater than a preset threshold.

With reference to the first aspect, in a second possible implementation of the first aspect, for each antenna, if a grounding part of the antenna is connected to one end of the metal radiating element, a radiating path is formed from a feeding branch circuit of the antenna to the grounding part, and another radiating path is formed from the feeding branch circuit of the antenna to one end that is of the metal radiating element and that is not connected to the grounding part. Alternatively, if a grounding part of the antenna is not connected to one end of the metal radiating element, one radiating path is formed from a feeding branch circuit of the antenna to each of two ends of the metal radiating element, and another radiating path is formed from the feeding branch circuit of the antenna to the grounding part of the antenna.

In the metal frame antenna provided in the second possible implementation of the first aspect, a location relationship between a grounding part of an antenna and a metal radiating element connected to the grounding part is specifically limited, so that each antenna can form at least one resonance frequency. Therefore, it is ensured that isolation between adjacent antennas meets a requirement, a frequency coverage area of the whole metal frame antenna is enlarged, and antenna utilization is further improved.

With reference to the first and the second possible implementations of the first aspect, in a third possible implementation of the first aspect, N is 3. The metal frame antenna specifically includes the metal frame of the terminal device and three feeding branch circuits. Four gaps are disposed on the metal frame, metal frames between the four gaps form three metal radiating elements, and the three metal radiating elements and the respectively connected feeding branch circuits and grounding parts form three antennas.

In the metal frame antenna provided in the third possible implementation of the first aspect, an example in which four gaps are disposed on a metal frame to form three metal radiating elements, and the three metal radiating elements and the respectively connected feeding branch circuits and grounding parts form three antennas is used for description, and a multiple-input multiple-output antenna solution is implemented.

With reference to the third possible implementation of the first aspect, in a fourth possible implementation of the first aspect, the three antennas are separately located at a top end of the metal frame and two corners of the top end.

Three antennas are separately disposed at a top end of a metal frame and two corners of the top end, so that interference to an antenna that is caused when a user uses a terminal device can be avoided, and antenna communication performance can be improved.

A second aspect provides a terminal device. The terminal device includes a housing, a metal frame, and N feeds, where N is an integer not less than 3. The N feeds are located in the housing, and all the N feeds are disposed on a printed circuit board of the terminal device. Each feed includes a baseband processing circuit, a frequency mixing circuit, and a feeding radio frequency circuit that are connected to each other. A metal frame antenna is disposed on the metal frame. The metal frame antenna is the metal frame antenna provided in any one of the first to the fourth possible implementations of the first aspect. N feeding branch circuits of the metal frame antenna are respectively connected to the N feeds.

In the terminal device provided in the second aspect, a feeding branch circuit of a metal frame antenna is connected to a feed, a feeding radio frequency circuit of the feed provides excitation for the metal frame antenna, and a baseband processing circuit and a frequency mixing circuit included in the feed process a signal generated by the metal frame antenna, so that antenna communication performance is improved.

With reference to the second aspect, in a first possible implementation of the second aspect, each feeding branch circuit of the metal frame antenna includes a feed point and a matching circuit, each feed point is connected to a corresponding metal radiating element by using the corresponding matching circuit, and each feed point is connected to the feeding radio frequency circuit.

With reference to the first possible implementation of the second aspect, in a second possible implementation of the second aspect, for each antenna, a metal radiating element of the antenna is further connected to a suspended stub, and a radiating path is formed from the feeding branch circuit to the suspended stub.

With reference to either of the first and the second possible implementations of the second aspect, in a third possible implementation of the second aspect, for each antenna, a metal radiating element of the antenna is further connected to a tuned circuit, and the tuned circuit is configured to adjust a resonance frequency of each radiating path formed in the antenna.

With reference to the third possible implementation of the second aspect, in a fourth possible implementation of the second aspect, the tuned circuit includes a capacitor and/or an inductive tuned circuit.

In the metal frame antenna and the terminal device provided in the embodiments, N+1 gaps are disposed on a metal frame of the terminal device, metal frames between the N+1 gaps form N metal radiating elements, and the N metal radiating elements are respectively connected to corresponding feeding branch circuits and corresponding grounding parts to form the metal frame antenna. In addition, an end part of a metal radiating element on at least one of two sides of each of N−1 gaps between the N metal radiating elements is connected to a grounding part. Therefore, mutual interference between adjacent antennas is reduced, antenna communication performance of the terminal device is improved, antenna utilization is improved, and relatively high isolation between adjacent antennas is further ensured.

BRIEF DESCRIPTION OF THE DRAWINGS

To describe the technical solutions in the embodiments of the present invention more clearly, the following briefly describes the accompanying drawings required for describing the embodiments. Apparently, the accompanying drawings in the following description show some embodiments of the present invention, and persons of ordinary skill in the art may still derive other drawings from these accompanying drawings without creative efforts.

DETAILED DESCRIPTION OF ILLUSTRATIVE EMBODIMENTS

To make the objectives, technical solutions, and advantages of the embodiments of the present invention clearer, the following clearly and completely describes the technical solutions in the embodiments of the present invention with reference to the accompanying drawings in the embodiments of the present invention. Apparently, the described embodiments are some but not all of the embodiments of the present invention. All other embodiments obtained by persons of ordinary skill in the art based on the embodiments of the present invention without creative efforts shall fall within the protection scope of the present invention.

An antenna in a terminal device may be a loop antenna, an inverted F antenna, a strip antenna, a plane inverted F antenna, a slot antenna, a hybrid antenna including more than one type of antenna structure, or an antenna in another appropriate form.

Because a terminal device with a metal housing and a metal frame is not only fashionable and textured, but also is more durable, people tend to purchase the terminal device with a metal housing and a metal frame. However, the metal housing and the metal frame shield an electromagnetic wave transmitted or received by an antenna in the terminal device. Consequently, communication performance of the terminal device is affected, and antenna utilization is low. For this technical problem, the embodiments of the present invention provide a metal frame antenna and a terminal device. In a solution in which a multiple-input multiple-output metal frame antenna is disposed on a metal frame of a terminal device as a terminal device antenna, high antenna utilization of the terminal device with a whole metal housing is ensured, and relatively high isolation between adjacent antennas is further ensured.

Figure 1:
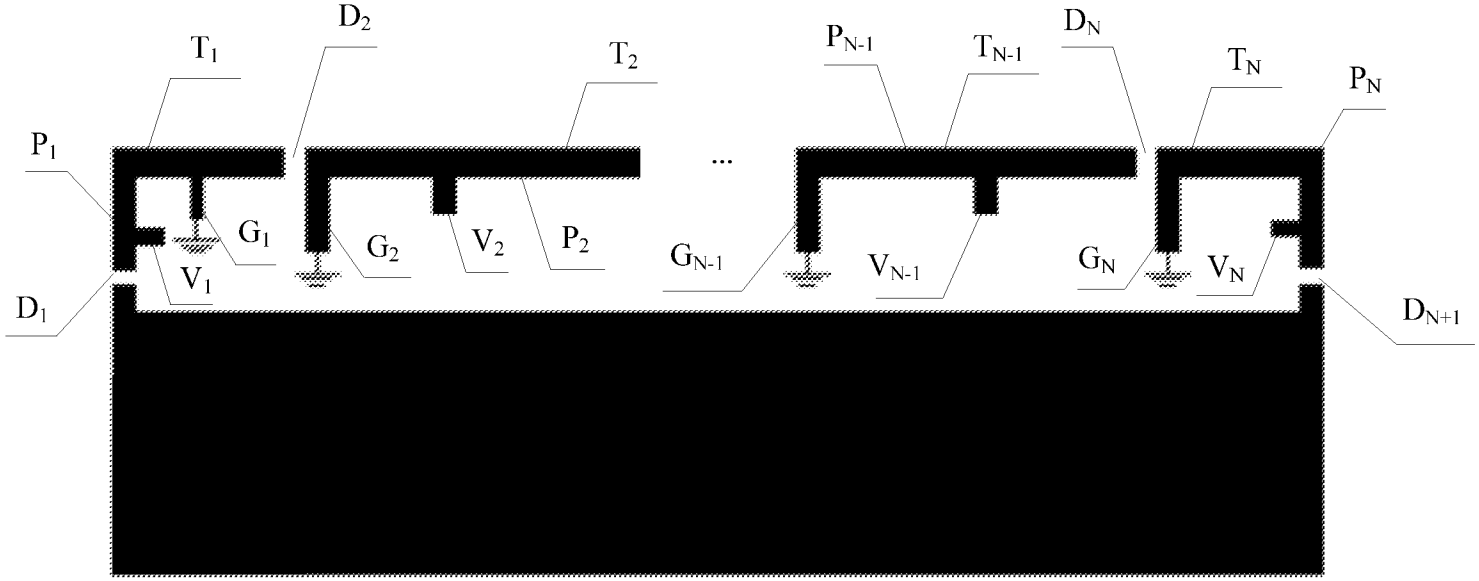
FIG. 1 is a schematic structural diagram of Embodiment 1 of a metal frame antenna according to an embodiment of the present invention.

FIG. 1 is a schematic structural diagram of Embodiment 1 of a metal frame antenna according to an embodiment of the present invention. As shown in FIG. 1, the metal frame antenna provided in Embodiment 1 of the present invention includes a metal frame of a terminal device and N feeding branch circuits, where N is an integer not less than 3, and the N feeding branch circuits are $V_1$, $V_2$ . . . , $V_{N-1}$, and $V_N$.

N+1 gaps are disposed on the metal frame, and are $D_1$, $D_2$ . . . , $D_N$, and $D_{N+1}$. Metal frames between the N+1 gaps form N metal radiating elements: $P_1$, $P_2$ . . . , $P_{N-1}$, and $P_N$, and the N metal radiating elements are respectively connected to the N feeding branch circuits. The N metal radiating elements are further respectively connected to grounding parts, and N grounding parts in FIG. 1 are $G_1$, $G_2$ . . . , $G_{N-1}$, and $G_N$. The N metal radiating elements and the respectively connected feeding branch circuits and grounding parts form N antennas, at least one radiating path is formed in each antenna, and each radiating path has at least one resonance frequency. In addition, an end part of a metal radiating element on at least one of two sides of each of N−1 gaps between the N metal radiating elements is connected to a grounding part.

Specifically, the metal radiating element $P_1$, the feeding branch circuit $V_1$, and the grounding part $G_1$ form an antenna $T_1$, the metal radiating element $P_2$, the feeding branch circuit $V_2$, and the grounding part $G_2$ form an antenna $T_2$, and similarly, the metal radiating element $P_N$, the feeding branch circuit $V_N$, and the grounding part $G_N$ form an antenna $T_N$.

Optionally, each metal radiating element may be connected to multiple grounding parts. That is, the end part of the metal radiating element on the at least one of the two sides of each of the N−1 gaps between the N metal radiating elements is connected to at least one grounding part.

In the metal frame antenna provided in Embodiment 1 of the present invention, N+1 gaps are disposed on a metal frame of a terminal device, metal frames between the N+1 gaps form N metal radiating elements, and the N metal radiating elements are respectively connected to corresponding feeding branch circuits and corresponding grounding parts to form the metal frame antenna. An end part of a metal radiating element on at least one of two sides of each of N−1 gaps between the N metal radiating elements is connected to a grounding part. Therefore, multiple independent antennas are formed using metal frames of the terminal device, and feeding branch circuits and grounding parts of the antennas have relative location relationships, so that antenna communication performance of the terminal device is improved, antenna utilization is improved, and relatively high isolation between adjacent antennas is further ensured.

Figure 2:
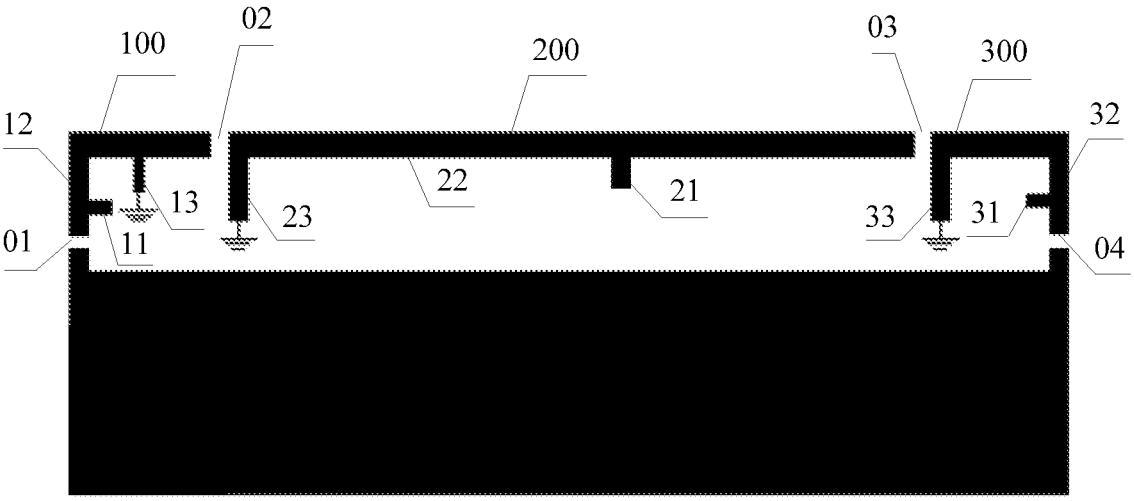
FIG. 2 is a schematic structural diagram of Embodiment 2 of a metal frame antenna according to an embodiment of the present invention.

FIG. 2 is a schematic structural diagram of Embodiment 2 of a metal frame antenna according to an embodiment of the present invention. In Embodiment 2 of the present invention, an example in which N is equal to 3 is used to describe Embodiment 1 in detail. That is, in Embodiment 2 of the present invention, an example in which the metal frame antenna includes three feeding branch circuits, and four gaps are disposed on a metal frame is used for description. However, a quantity of feeding branch circuits in the metal frame antenna provided in this embodiment of the present invention and a quantity of gaps disposed on the metal frame are not limited in this embodiment.

As shown in FIG. 2, the metal frame antenna provided in Embodiment 2 of the present invention includes the metal frame and the three feeding branch circuits. Specifically, the three feeding branch circuits in Embodiment 2 of the present invention are a first feeding branch circuit 11, a second feeding branch circuit 21, and a third feeding branch circuit 31. The four gaps disposed on the metal frame are a first gap 01, a second gap 02, a third gap 03, and a fourth gap 04. A metal frame between the first gap 01 and the second gap 02 forms a first metal radiating element 12, a metal frame between the second gap 02 and the third gap 03 forms a second metal radiating element 22, and a metal frame between the third gap 03 and the fourth gap 04 forms a third metal radiating element 32. The first metal radiating element 12 is connected to the first feeding branch circuit 11 and a first grounding part 13 to form a first antenna 100, the second metal radiating element 22 is connected to the second feeding branch circuit 21 and a second grounding part 23 to form a second antenna 200, and the third metal radiating element 32 is connected to the third feeding branch circuit 31 and a third grounding part 33 to form a third antenna 300.

Optionally, locations of N antennas formed in this embodiment of the present invention are symmetrical along a vertical center line of the metal frame. Specifically, when the metal frame antenna includes three antennas, the three antennas are separately located at a top end of the metal frame and two corners of the top end.

Because a feeding branch circuit of an antenna is connected to a metal radiating element of the antenna, when the feeding branch circuit directly transmits a radio signal to a metal radiating element between the feeding branch circuit and a grounding part of the antenna, an electric field around the metal radiating element between the feeding branch circuit and the grounding part changes. Therefore, the metal radiating element between the feeding branch circuit and the grounding part generates a resonance, so as to radiate the radio signal outwards. When the metal radiating element between the feeding branch circuit and the grounding part receives a radio signal, a signal path is opposite to a signal path in the foregoing radiating path. Therefore, a radiating path is formed from the feeding branch circuit to the grounding part. Likewise, when the feeding branch circuit directly transmits radio signals to metal radiating elements between the feeding branch circuit and two ends of the metal radiating element, electric fields around the metal radiating elements between the feeding branch circuit and the two ends of the metal radiating element change. Therefore, the metal radiating elements between the feeding branch circuit and the two ends of the metal radiating element generate resonances, so as to radiate the radio signals outwards. When the metal radiating elements between the feeding branch circuit and the two ends of the metal radiating element receive radio signals, signal paths are opposite to signal paths in the foregoing radiating paths. Therefore, radiating paths may be separately formed from the feeding branch circuit to the two ends of the metal radiating element. Therefore, at least one radiating path may be formed in each antenna, and each radiating path has at least one resonance frequency.

Specifically, for each antenna, if a grounding part of the antenna is connected to one end of a metal radiating element of the antenna, a radiating path is formed from a feeding branch circuit of the antenna to the grounding part, and another radiating path is formed from the feeding branch circuit of the antenna to one end that is of the metal radiating element and that is not connected to the grounding part; or if a grounding part of the antenna is not connected to one end of a metal radiating element of the antenna, one radiating path is formed from a feeding branch circuit of the antenna to each of two ends of the metal radiating element, and another radiating path is formed from the feeding branch circuit of the antenna to the grounding part of the antenna.

For example, as shown in FIG. 2, because the first grounding part 13 of the first antenna 100 is not connected to one end of the first metal radiating element 12, a first radiating path and a second radiating path may be separately formed from the first feeding branch circuit 11 to two ends of the first metal radiating element 12, and a third radiating path is formed from the first feeding branch circuit 11 to the first grounding part 13. Because the second grounding part 23 of the second antenna 200 is connected to one end of the second metal radiating element 22, a fourth radiating path is formed from the second feeding branch circuit 21 to the second grounding part 23, and a fifth radiating path is formed from the second feeding branch circuit 21 to one end that is of the second metal radiating element 22 and that is not connected to the second grounding part 23. Likewise, because the third grounding part 33 of the third antenna 300 is connected to one end of the third metal radiating element 32, a sixth radiating path is formed from the third feeding branch circuit 31 to the third grounding part 33, and a seventh radiating path is formed from the third feeding branch circuit 31 to one end that is of the third metal radiating element 32 and that is not connected to the third grounding part 33.

In this embodiment of the present invention, a resonance frequency of each radiating path is related to a length from a feeding branch circuit to a grounding part of the antenna or a length from a feeding branch circuit to one of two ends of a metal radiating element of the antenna. If the length from the feeding branch circuit to the grounding part of the antenna is longer, the resonance frequency of the radiating path is lower. If the length from the feeding branch circuit to one of the two ends of the metal radiating element of the antenna is longer, the resonance frequency of the radiating path is lower.

The length from the feeding branch circuit to the grounding part of the antenna or the length from the feeding branch circuit to one of the two ends of the metal radiating element of the antenna is one-fourth of an operating wavelength of a fundamental frequency of the formed radiating path. Specifically, the length from the feeding branch circuit to the grounding part of the antenna or the length from the feeding branch circuit to one of the two ends of the metal radiating element of the antenna is obtained by multiplying a quotient of dividing a speed of light by the fundamental frequency by ¼. Therefore, after a relative connection location of the feeding branch circuit and the metal radiating element of the antenna is determined, a resonance frequency required by each radiating path for operating is determined, so that the formed radiating path can operate at the fundamental frequency by adjusting the length from the feeding branch circuit to the grounding part of the antenna or the length from the feeding branch circuit to one of the two ends of the metal radiating element of the antenna.

Specifically, as shown in FIG. 2, in this embodiment, for the first antenna 100, after a relative connection location of the first feeding branch circuit 11 and the first metal radiating element 12 is determined, if a resonance frequency required by the first radiating path for operating is 5 GHz, a length 15 millimeters from the first feeding branch circuit 11 to one end that is on a side of the first gap 01 and that is of the first metal radiating element 12 is obtained by means of calculation by multiplying a quotient of dividing the speed of light by the resonance frequency 5 GHz by ¼. The length from the first feeding branch circuit 11 to the end that is on the side of the first gap 01 and that is of the first metal radiating element 12 is adjusted to 15 millimeters, so that the formed first radiating path can operate at the resonance frequency 5 GHz. Specifically, likewise, a length from the first feeding branch circuit 11 to one end that is on a side of the second gap 02 and that is of the first metal radiating element 12 is adjusted to 47.6 millimeters, so that the second radiating path that is applicable to operating of a GPS (approximately 1.575 GHz) can be formed. A length from the first feeding branch circuit 11 to the first grounding part 13 is adjusted to 31.2 millimeters, so that the third radiating path that is applicable to operating of 2.4 GHz WiFi can be formed.

For the second antenna 200, after a relative connection location of the second feeding branch circuit 21 and the second metal radiating element 22 is determined, a length from the second feeding branch circuit 21 to the second grounding part 23 is adjusted to 78.1 millimeters, so that the fourth radiating path whose resonance frequency is 960 MHz can be formed. A length from the second feeding branch circuit 21 to one end that is on a side of the third gap 03 and that is of the second metal radiating element 22 is adjusted to 44.1 millimeters, so that the fifth radiating path whose resonance frequency is 1700 MHz can be formed. Further, a tuned circuit connected to each radiating path is adjusted, so that the fourth radiating path can operate on a low frequency band and an operating range of a resonance frequency is from 704 MHz to 960 MHz, and the fifth radiating path can operate on an intermediate frequency band and an operating range of a resonance frequency is from 1700 MHz to 2170 MHz.

For the third antenna 300, after a relative connection location of the third feeding branch circuit 31 and the third metal radiating element 32 is determined, a length from the third feeding branch circuit 31 to the third grounding part 33 is adjusted to 31.2 millimeters, so that the sixth radiating path that is applicable to operating of 2.4 GHz WiFi can be formed. A length from the third feeding branch circuit 31 to one end that is on a side of the fourth gap 04 and that is of the third metal radiating element 32 is adjusted to 15 millimeters, so that the seventh radiating path whose resonance frequency is 5 GHz can be formed.

In addition, a tuned circuit may be further connected to each of the foregoing radiating paths, so that a harmonic of a resonance frequency of the radiating path enters into an operating frequency band, so as to extend the metal frame antenna to cover multiple frequency bands. The harmonic herein may be a first harmonic, a second harmonic, or the like. For example, in this embodiment of the present invention, a tuned circuit (not shown) is connected to the second metal radiating element 22, so that the resonance frequency of the fourth radiating path can enter into an operating frequency band of a third harmonic of the fundamental frequency, and the fourth radiating path operates on a high frequency band from 2300 MHz to 2700 MHz.

It should be noted that, in the metal frame antenna provided in this embodiment of the present invention, an end part of a metal radiating element on at least one of two sides of each of N−1 gaps between N metal radiating elements is connected to a grounding part, so that isolation between two adjacent antennas is greater than a preset threshold.

Specifically, in the metal frame antenna provided in this embodiment of the present invention, when isolation between adjacent antennas reaches 30 dB, an antenna system requirement can be usually met. Optionally, in consideration of a particular margin, the preset threshold may be set to 40 dB. In this way, interference between adjacent antennas can be basically eliminated. However, the preset threshold of isolation may be specifically set according to a system requirement. This is not limited in this embodiment of the present invention.

As shown in FIG. 2, in the metal frame antenna provided in Embodiment 2 of the present invention, an end part of a metal radiating element on at least one of two sides of the second gap 02 between the first metal radiating element 12 and the second metal radiating element 22 and two sides of the third gap 03 between the second metal radiating element 22 and the third metal radiating element 32 is connected to a grounding part. In the present invention, relatively high isolation between formed antennas can be ensured by setting a relative location relationship between a feeding branch circuit and a grounding part.

For example, the second grounding part 23 of the second antenna 200 is disposed on the right side of the second gap 02, and the third grounding part 33 of the third antenna 300 is disposed on the right side of the third gap 03. That is, the second grounding part 23 is disposed on the left side of the second metal radiating element 22, and the third grounding part 33 is disposed on the left side of the third metal radiating element 32. It should be noted that, if a metal radiating element has a cross section structure, each antenna has at least one grounding part. That is, the second antenna 200 includes multiple second grounding parts 23, and the third antenna 300 includes multiple third grounding parts 33. However, a quantity of grounding parts included in each antenna is not limited in the present invention.

Therefore, for each antenna, a feeding part of the antenna can form a radiating path only with a metal radiating element or a grounding part of the antenna. In a gap formed between two metal radiating elements, a current generated by a feeding part is absorbed by a grounding part located at an end part of a metal radiating element. Therefore, a current generated in each antenna does not interfere with a radiating path formed in another antenna, so as to ensure relatively high isolation between antennas.

In the metal frame antenna provided in Embodiment 2 of the present invention, four gaps are disposed on a metal frame of a terminal device, metal frames between the four gaps form three metal radiating elements, and the three metal radiating elements are respectively connected to corresponding feeding branch circuits and corresponding grounding parts to form the metal frame antenna. In addition, an end part of a metal radiating element on at least one of two sides of each of N−1 gaps between N metal radiating elements is connected to a grounding part. Therefore, multiple independent antennas are formed by using metal frames of the terminal device, and feeding branch circuits and grounding parts of the antennas have relative location relationships. A metal housing and the metal frame do not shield an electromagnetic wave transmitted or received by an antenna in the terminal device, so that antenna communication performance of the terminal device is improved, antenna utilization is improved, and relatively high isolation between adjacent antennas is further ensured.

A form of the metal frame antenna provided in this embodiment of the present invention is not limited to the metal frame antennas shown in FIG. 1 and FIG. 2. The following enumerates other actual forms of the metal frame antenna provided in this embodiment of the present invention.

Figure 3:
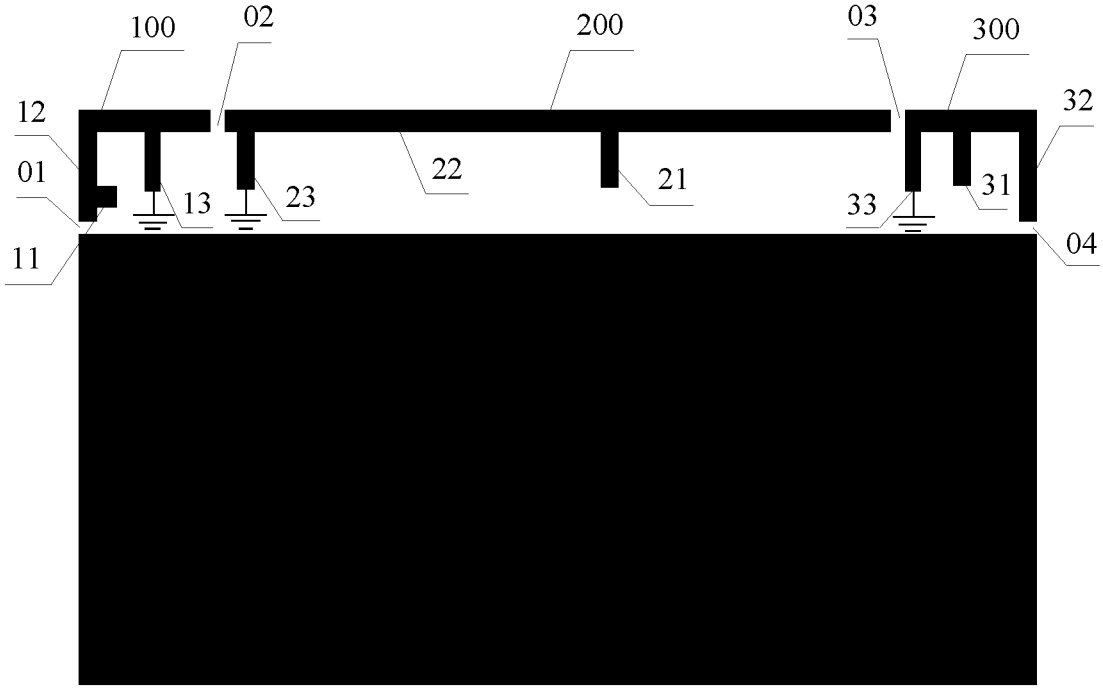
FIG. 3 is a schematic structural diagram of Embodiment 3 of a metal frame antenna according to an embodiment of the present invention.

FIG. 3 is a schematic structural diagram of Embodiment 3 of a metal frame antenna according to an embodiment of the present invention. As shown in FIG. 3, a difference between the metal frame antenna in this embodiment and that in FIG. 2 lies in that, in this embodiment, a third feeding branch circuit 31 of a third antenna 300 is closer to a third grounding part 33.

Because a resonance frequency of each radiating path is related to a length of a metal radiating element that forms the radiating path, if a length of a metal radiating element in a radiating path is longer, a resonance frequency of the radiating path is lower. Therefore, when the third feeding branch circuit 31 is connected to a location shown in FIG. 3, a resonance frequency of a sixth radiating path formed from the third feeding branch circuit 31 to the third grounding part 33 is different from a resonance frequency of the sixth radiating path formed in FIG. 2. In this case, the resonance frequency of the sixth radiating path is higher in FIG. 3. A resonance frequency of a seventh radiating path formed from the third feeding branch circuit 31 to one end that is of a third metal radiating element 32 and that is not connected to the third grounding part 33 is different from a resonance frequency of the seventh radiating path formed in FIG. 2. In this case, the resonance frequency of the seventh radiating path is lower in FIG. 3.

It should be noted that, a resonance frequency of a radiating path may change if a connection location of a feeding branch circuit and a metal radiating element in each antenna changes. A specific connection location of a feeding branch circuit and a metal radiating element is not limited in this embodiment of the present invention.

Figure 4:
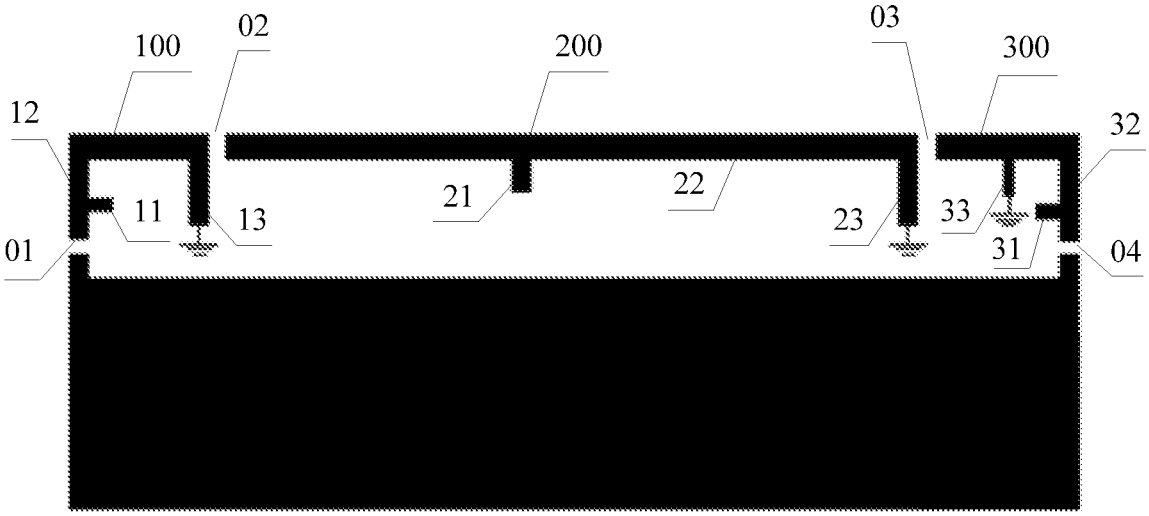
FIG. 4 is a schematic structural diagram of Embodiment 4 of a metal frame antenna according to an embodiment of the present invention.

FIG. 4 is a schematic structural diagram of Embodiment 4 of a metal frame antenna according to an embodiment of the present invention. As shown in FIG. 4, a difference between the metal frame antenna in this embodiment and that in FIG. 2 lies in that, in this embodiment, a first grounding part 13 of a first antenna 100 is connected to one end that is of a first metal radiating element 12 and that is close to a second antenna 200, a second grounding pall 23 of the second antenna 200 is connected to one end that is of a second metal radiating element 22 and that is close to a third antenna 300, and a third grounding pall 33 of the third antenna 300 is not connected to one end of a third metal radiating element 32.

In the metal frame antenna provided in this embodiment of the present invention, a first radiating path is formed from a first feeding branch circuit 11 to one end that is of the first metal radiating element 12 and that is not connected to the first grounding part 13, and a second radiating path is formed from the first feeding branch circuit 11 to the first grounding part 13. A third radiating path is formed from a second feeding branch circuit 21 to one end that is of the second metal radiating element 22 and that is not connected to the second grounding part 23, and a fourth radiating path is formed from the second feeding branch circuit 21 to the second grounding part 23. A fifth radiating path and a sixth radiating path are separately formed from a third feeding branch circuit 31 to two ends of the third metal radiating element 32, and a seventh radiating path is formed from the third feeding branch circuit 31 to the third grounding part 33. Likewise, a resonance frequency of each radiating path is related to a length from a feeding branch circuit to a grounding part of the antenna or a length from a feeding branch circuit to one of two ends of a metal radiating element of the antenna. If the length from the feeding branch circuit to the grounding part of the antenna is longer, the resonance frequency of the radiating path is lower. If the length from the feeding branch circuit to one of the two ends of the metal radiating element of the antenna is longer, the resonance frequency of the radiating path is lower.

In the metal frame antenna shown in FIG. 1, FIG. 2, FIG. 3, or FIG. 4, only a case in which each radiating path operates at a fundamental frequency is shown. However, the metal frame antenna provided in this embodiment of the present invention is not limited thereto. A harmonic of a fundamental frequency of each radiating path may enter into an operating frequency band by adjusting a matching circuit of each antenna or a tuned circuit connected to a metal radiating element of each antenna, so as to extend the metal frame antenna to cover multiple frequency bands. The harmonic herein may be a first harmonic, a second harmonic, or the like.

The metal frame antenna provided in this embodiment of the present invention may be independently configured to cover a same communications frequency band, an overlapped communications frequency band, or different non-overlapped communications frequency bands, and can be configured to implement an antenna diversity solution or a multiple-input multiple-output (MIMO) antenna solution. In addition, isolation between adjacent antennas can meet a specified requirement. Therefore, the metal frame antenna provided in this embodiment of the present invention may be configured to support any concerned communications frequency band. For example, a terminal device with a metal frame antenna can implement local area network communication, voice and data cellular phone communication, Global Positioning System (GPS) communication or other satellite navigation system communication, Bluetooth communication, and the like.

Figure 5:
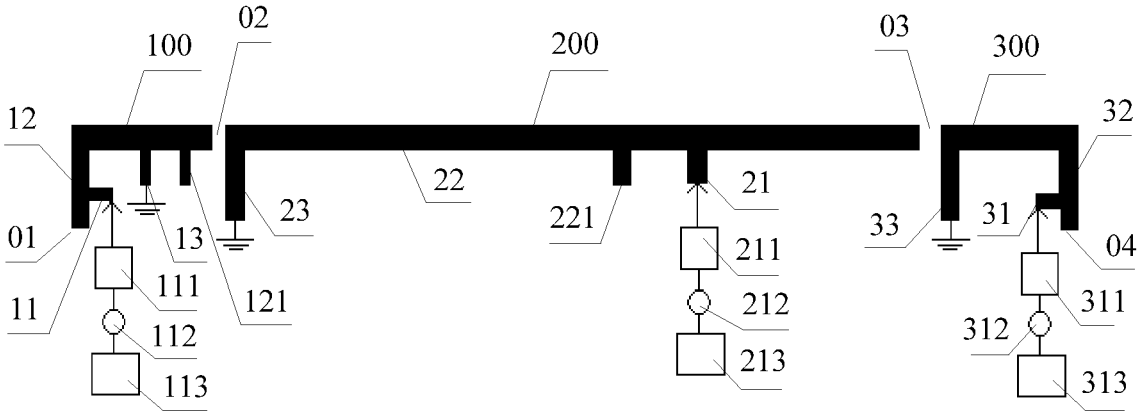
FIG. 5 is a schematic structural diagram of Embodiment 5 of a metal frame antenna according to an embodiment of the present invention.

FIG. 5 is a schematic structural diagram of Embodiment 5 of a metal frame antenna according to an embodiment of the present invention. The metal frame antenna shown in FIG. 2 is further described in Embodiment 5 of the present invention based on Embodiment 2. As shown in FIG. 5, in the metal frame antenna provided in Embodiment 5 of the present invention, each feeding branch circuit includes a feed point and a matching circuit, each feed point is connected to a corresponding metal radiating element by using a corresponding matching circuit, and each feed point is further connected to a feeding radio frequency circuit in a terminal device, so as to transmit a radio signal provided by the feeding radio frequency circuit to the metal frame antenna, or transmit, by using a corresponding feed point, a radio signal received by the metal frame antenna to the feeding radio frequency circuit.

Specifically, as shown in FIG. 5, a first feeding branch circuit 11 includes a first feed point in and a first matching circuit 112, a second feeding branch circuit 21 includes a second feed point 211 and a second matching circuit 212, and a third feeding branch circuit 31 includes a third feed point 311 and a third matching circuit 312. The first feed point 111 is not only connected to a first metal radiating element 12 by using the first matching circuit 112, but also is connected to a feeding radio frequency circuit 113 in the terminal device. The second feed point 211 is not only connected to a second metal radiating element 22 using the second matching circuit 212, but also is connected to a feeding radio frequency circuit 213 in the terminal device. The third feed point 311 is not only connected to a third metal radiating element 32 by using the third matching circuit 312, but also is connected to a feeding radio frequency circuit 313 in the terminal device.

The feeding radio frequency circuit includes but is not limited to a GPS receiver, a wireless local area network transceiver, a Bluetooth device, a transceiver for processing a cellular voice and a data service, and the like. A form of the feeding radio frequency circuit is not limited in the present invention.

All of the first matching circuit 112, the second matching circuit 212, and the third matching circuit 312 may be implemented by using filters or the like. However, this is not limited in the present invention.

Optionally, in the metal frame antenna provided in this embodiment, for each antenna, a metal radiating element of the antenna is further connected to a suspended stub, and a radiating path is formed from a feeding branch circuit of the antenna to the suspended stub of the antenna.

For example, as shown in FIG. 5, the first metal radiating element 12 of a first antenna 100 is further connected to a suspended stub 121, and an eighth radiating path is formed from the first feeding branch circuit 11 to the suspended stub 121. In the metal frame antenna provided in this embodiment of the present invention, a metal radiating element of each antenna may be connected to a suspended stub. The suspended stub may be disposed according to an actual requirement in the present invention. This is not limited in the present invention.

Further, in the metal frame antenna provided in this embodiment, for each antenna, a metal radiating element of the antenna is further connected to a tuned circuit, and the tuned circuit is configured to adjust a resonance frequency of each radiating path formed in the antenna.

For example, as shown in FIG. 5, the second metal radiating element 22 of a second antenna 200 is further connected to a tuned circuit 221, and the tuned circuit 221 is configured to adjust resonance frequencies of a fourth radiating path and a fifth radiating path formed in the antenna 200. In the metal frame antenna provided in this embodiment of the present invention, a metal radiating element of each antenna may be connected to a tuned circuit. The tuned circuit may be specifically disposed according to an actual requirement in the present invention. This is not limited in the present invention.

Optionally, the tuned circuit includes a capacitor and/or an inductive tuned circuit. Persons skilled in the art can dispose, on a metal radiating element of an antenna by means of theoretical calculation or experiment, a capacitor and/or an inductive component configured to tune a resonance frequency of a radiating path. Details are not described herein.

In the metal frame antenna provided in this embodiment of the present invention, a feed point of a feeding branch circuit is connected to a corresponding metal radiating element by using a corresponding matching circuit, and the feed point is connected to a feeding radio frequency circuit of a terminal device, so that communication between a signal in a feed and a signal received by the metal frame antenna can be implemented. A metal radiating element of an antenna is connected to a suspended stub, and a new radiating path may be formed from a feeding branch circuit of the antenna to the suspended stub, so that a frequency band covered by the metal frame antenna is broadened, and antenna performance is improved. A metal radiating element of an antenna is connected to a tuned circuit such as a capacitor or/and an inductor, so that a resonance frequency of a radiating path formed in the antenna can be adjusted, and controllability and operability are high.

Figure 6:
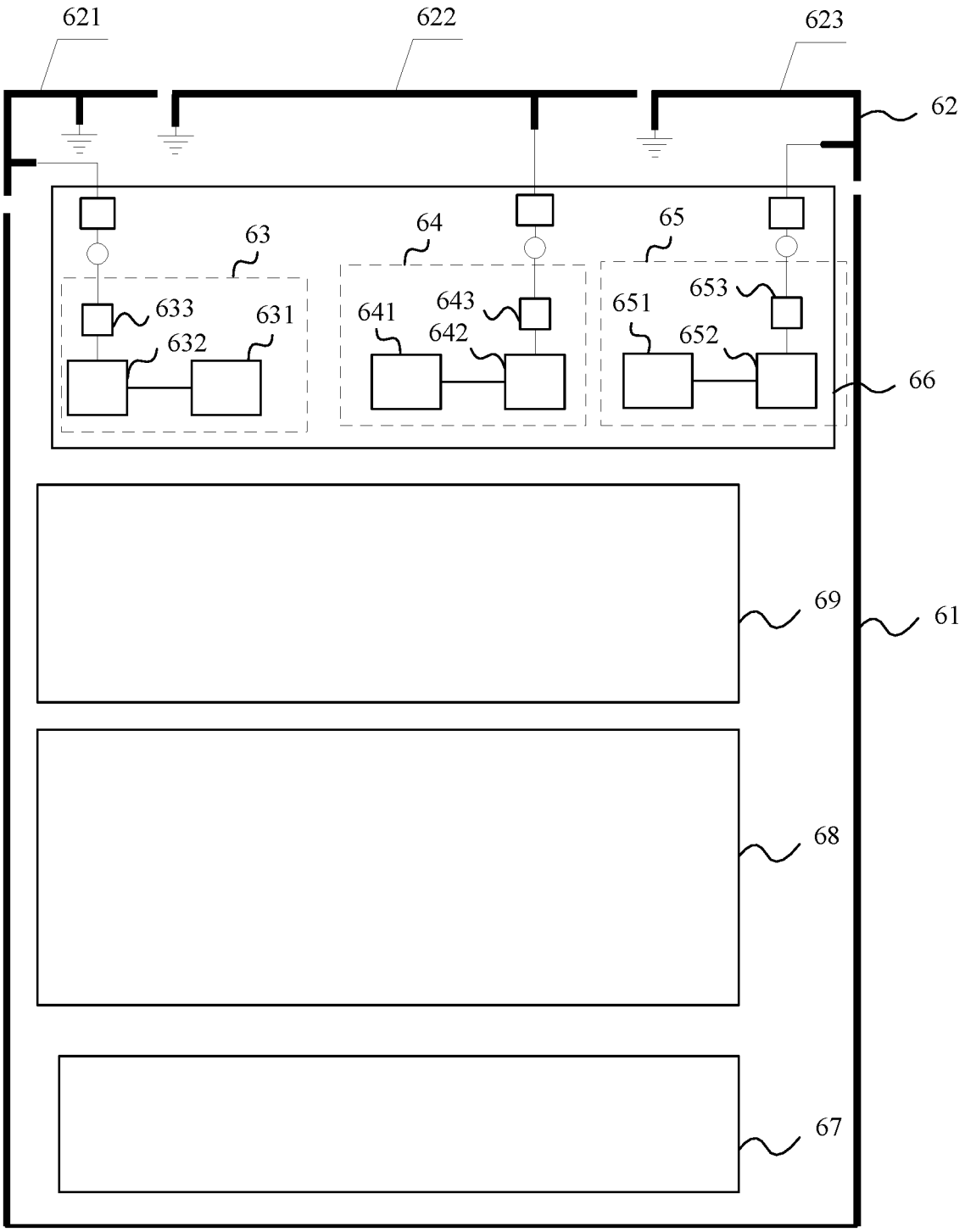
FIG. 6 is a schematic structural diagram of Embodiment 1 of a terminal device according to an embodiment of the present invention.

FIG. 6 is a schematic structural diagram of Embodiment 1 of a terminal device according to an embodiment of the present invention. The terminal device provided in this embodiment of the present invention includes a housing 61, a metal frame 62, and N feeds, where N is an integer not less than 3. The N feeds are located in the housing 61, all the N feeds are disposed on a printed circuit board of the terminal device, each feed includes a baseband processing circuit, a frequency mixing circuit, and a feeding radio frequency circuit that are connected to each other, and a metal frame antenna is disposed on the metal frame 62. The metal frame antenna in this embodiment of the present invention is any metal frame antenna in the embodiments shown in FIG. 1, FIG. 2, FIG. 3, FIG. 4, and FIG. 5.

Specifically, in this embodiment of the present invention, an example in which there are three feeds is used to describe the terminal device provided in this embodiment of the present invention. As shown in FIG. 6, the terminal device in this embodiment includes the housing 61, the metal frame 62, a first feed 63, a second feed 64, and a third feed 65.

All of the first feed 63, the second feed 64, and the third feed 65 are located in the housing 61, and all of the first feed 63, the second feed 64, and the third feed 65 are disposed on a printed circuit board 66 of the terminal device. Each feed includes a baseband processing circuit, a frequency mixing circuit, and a feeding radio frequency circuit that are connected to each other. That is, the first feed 63 includes a first baseband processing circuit 631, a first frequency mixing circuit 632, and a first feeding radio frequency circuit 633, the second feed 64 includes a second baseband processing circuit 641, a second frequency mixing circuit 642, and a second feeding radio frequency circuit 643, and the third feed 65 includes a third baseband processing circuit 651, a third frequency mixing circuit 652, and a third feeding radio frequency circuit 653.

The metal frame antenna is disposed on the metal frame 62, and the metal frame antenna includes a first antenna 621, a second antenna 622, and a third antenna 623.

The first feeding radio frequency circuit 633 is configured to process a radio frequency signal received by the first antenna 621 and send the processed signal to the first frequency mixing circuit 632 for down-conversion processing, and the first frequency mixing circuit 632 sends an intermediate frequency signal obtained after down-conversion to the first baseband processing circuit 631 for processing. Alternatively, the first baseband processing circuit 631 sends a baseband signal to the first frequency mixing circuit 632 for up-conversion to obtain a radio frequency signal, then the first frequency mixing circuit 632 sends the radio frequency signal to the first feeding radio frequency circuit 633, and the first feeding radio frequency circuit 633 transmits the radio frequency signal by using the first antenna 621.

Likewise, the second feeding radio frequency circuit 643 is configured to process a radio frequency signal received by the second antenna 622 and send the processed signal to the second frequency mixing circuit 642 for down-conversion processing, and the second frequency mixing circuit 642 sends an intermediate frequency signal obtained after down-conversion to the second baseband processing circuit 641 for processing. Alternatively, the second baseband processing circuit 641 sends a baseband signal to the second frequency mixing circuit 642 for up-conversion to obtain a radio frequency signal, then the second frequency mixing circuit 642 sends the radio frequency signal to the second feeding radio frequency circuit 643, and the second feeding radio frequency circuit 643 transmits the radio frequency signal by using the second antenna 622.

The third feeding radio frequency circuit 653 is configured to process a radio frequency signal received by the third antenna 623 and send the processed signal to the third frequency mixing circuit 652 for down-conversion processing, and the third frequency mixing circuit 652 sends an intermediate frequency signal obtained after down-conversion to the third baseband processing circuit 651 for processing. Alternatively, the third baseband processing circuit 651 sends a baseband signal to the third frequency mixing circuit 652 for up-conversion to obtain a radio frequency signal, then the third frequency mixing circuit 652 sends the radio frequency signal to the third feeding radio frequency circuit 653, and the third feeding radio frequency circuit 653 transmits the radio frequency signal by using the third antenna 623.

It should be noted that, other components such as an input/output device 67, a processor 68, and a memory 69 may be further included in the housing 61 of the terminal device shown in FIG. 6. Locations of the input/output device 67, the processor 68, and the memory 69 in FIG. 6 are only examples for description, and are not limited in this embodiment of the present invention.

The input/output device 67 may be configured to provide data for the terminal device and provide the data in the terminal device for an external device. The input/output device 67 may include a touchscreen, a button, a joystick, a click wheel, a scroll wheel, a touchpad, a keypad, a keyboard, a microphone, a loudspeaker, an audio generator, a vibrator, a camera, a sensor, a light emitting diode and another status indicator, a data port, and the like.

The processor 68 may be configured to receive data input by the input/output device 67, and control an operation of the terminal device. The processor 68 may be one or more microprocessors, microcontrollers, digital signal processors, baseband processors, power supply management units, audio codec chips, application-specific integrated circuits, or the like.

The memory 69 may include a hard disk drive memory, a non-volatile memory (such as a flash memory that is configured to form a solid state drive, or another electrically programmable read-only memory), a volatile memory (such as a static or dynamic random access memory), and the like. The memory 69 is configured to store data processed by the processor 68.

The terminal device shown in this embodiment may be any portable terminal device that needs to perform wireless communication, for example, a mobile phone or a tablet computer. The metal frame antenna may be any metal frame antenna in the embodiments shown in FIG. 1, FIG. 2, FIG. 3, FIG. 4, and FIG. 5. For a specific structure and an implementation principle of the metal frame antenna, refer to the metal frame antenna in the embodiment shown in FIG. 1, FIG. 2, FIG. 3, FIG. 4, or FIG. 5. Details are not described herein again.

Finally, it should be noted that the foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some or all technical features thereof. Therefore, the protection scope of the present invention shall be subject to the protection scope of the claims.

What is claimed is:

1. A metal frame antenna, comprising:

a metal frame, wherein the metal frame is configured to be comprised in a terminal device; and N feeding branch circuits, wherein N is an integer not less than 3;

wherein the metal frame comprises N+1 gaps, the N+1 gaps define N metal radiating elements in a manner that the N+1 gaps isolate each of the N metal radiating elements from others of the N metal radiating elements, the N metal radiating elements are connected to the N feeding branch circuits in a one to one manner, the N metal radiating elements are further respectively connected to grounding parts, wherein the N metal radiating elements, the N feeding branch circuits, and the grounding parts form N antennas, a radiating path is formed in each antenna of the N antennas, and each radiating path in each antenna of the N antennas has a resonance frequency; and wherein for each of the N+1 gaps, at least one of the N metal radiating elements defines the respective gap at least in part, and the at least one of the N metal radiating elements comprises an end part that is connected to a grounding part of the grounding parts.

2. The metal frame antenna according to claim 1, wherein for each of the N+1 gaps, the connection of the end part of the at least one N metal radiating elements to the grounding part of the grounding parts causes isolation between two antennas of the N antennas to be greater than a preset threshold, wherein the two antennas of the N antennas are adjacent to each other across the respective gap.

3. The metal frame antenna according to claim 1, wherein for each antenna of the N antennas, when a first end part of a metal radiating element that corresponds to the respective antenna is connected to a grounding part that corresponds to the respective antenna, a first radiating path is formed and a second radiating path are formed, wherein the first radiating path extends between a feeding branch circuit that corresponds to the respective antenna and the grounding part that corresponds to the respective antenna, and the second radiating path extends between the feeding branch circuit that corresponds to the respective antenna to a second end part of the metal radiating element that corresponds to the respective antenna, wherein the second end part of the metal radiating element that corresponds to the respective antenna is not connected to the grounding part.

4. The metal frame antenna according to claim 1, wherein for each antenna of the N antennas, when a grounding part that corresponds to the respective antenna is disconnected from two end parts of the metal radiating element that corresponds to the respective antenna, a first radiating path is formed from a feeding branch circuit that corresponds to the respective antenna to a first end part of the two end parts of the metal radiating element that corresponds to the respective antenna, a second radiating path is formed from the feeding branch circuit that corresponds to the respective antenna to a second end part of the two end parts of the metal radiating element that corresponds to the respective antenna, and a third radiating path is formed from the feeding branch circuit that corresponds to the respective antenna to the grounding part that corresponds to the respective antenna, wherein the first end part is opposite to the second end part.

5. The metal frame antenna according to claim 1, wherein N is 3;

wherein the metal frame antenna comprises the metal frame and three feeding branch circuits; and wherein the metal frame comprises four gaps, the four gaps define three metal radiating elements, and the three metal radiating elements and the three feeding branch circuits and grounding parts form three antennas.

6. The metal frame antenna according to claim 5, wherein the three antennas are respectively disposed at a top end of the metal frame and two corners of the top end.

7. A terminal device, comprising:

a housing;

a metal frame;

a printed circuit board; and

N feeds, wherein N is an integer not less than 3;

wherein the N feeds are located in the housing, each of the N feeds are disposed on the printed circuit board, each feed of the N feeds comprises a baseband processing circuit, a frequency mixing circuit, and a feeding radio frequency circuit that are connected to each other;

wherein the metal frame comprises a metal frame antenna, and the metal frame antenna comprises N feeding branch circuits;

wherein the metal frame comprises N+1 gaps, the N+1 gaps define N metal radiating elements in a manner that the N+1 gaps isolate each of the N metal radiating elements from others of the N metal radiating elements, the N metal radiating elements are connected to the N feeding branch circuits in a one to one manner, the N metal radiating elements are further respectively connected to grounding parts, wherein the N metal radiating elements, the N feeding branch circuits, and the grounding parts form N antennas, a radiating path is formed in each antenna of the N antennas, and each radiating path in each antenna of the N antennas has a resonance frequency; and wherein for each of the N+1 gaps, at least one of the N metal radiating elements defines the respective gap at least in part, and the at least one of the N metal radiating elements comprises an end part that is connected to a grounding part of the grounding parts; and wherein the N feeding branch circuits are respectively connected to the N feeds.

8. The terminal device according to claim 7, wherein each feeding branch circuit of the N feeding branch circuits comprises a feed point, each feed point is connected to a corresponding metal radiating element using a corresponding matching circuit, and each feed point is connected to a corresponding feeding radio frequency circuit.

9. The terminal device according to claim 8, wherein for each antenna of the N antennas, a metal radiating element of the respective antenna is further connected to a suspended stub, and a radiating path of the respective antenna is formed from the feeding branch circuit to the suspended stub.

10. The terminal device according to claim 7, wherein for each antenna, a metal radiating element of the respective antenna is further connected to a tuned circuit, and the tuned circuit is configured to adjust a resonance frequency of each radiating path formed in the respective antenna.

11. The terminal device according to claim 10, wherein the tuned circuit comprises a capacitor.

12. The terminal device according to claim 10, wherein the tuned circuit comprises an inductive tuned circuit.

13. A terminal device, comprising:

a housing;

a metal frame, wherein the housing and the metal frame are configured to jointly provide an enclosure;

a printed circuit board disposed inside the enclosure; and

N feeds disposed inside the enclosure, wherein N is an integer not less than 3;

wherein each feed of the N feeds comprises a baseband processing circuit, a frequency mixing circuit, and a feeding radio frequency circuit, and wherein each feed of the N feeds is comprised in a first integrated circuit, and the first integrated circuit is disposed inside the enclosure;

wherein the metal frame comprises N+1 gaps, the N+1 gaps define N metal radiating elements in a manner that the N+1 gaps physically isolate each of the N metal radiating elements from others of the N metal radiating elements;

wherein each of the N metal radiating elements is electrically connected to a feeding branch circuit of N feeding branch circuits, and each of the N feeding branch circuits is electrically connected to a feed of the N feeds;

wherein each of the N metal radiating elements is electrically connected to a grounding part of N grounding parts;

wherein the N metal radiating elements, the N feeding branch circuits, and the N grounding parts form N antennas; and wherein for each of the N+1 gaps, at least one of the N metal radiating elements defines the respective gap at least in part, and the at least one of the N metal radiating elements comprises an end part that is connected to one of the N grounding parts.

14. The terminal device according to claim 13, wherein a first antenna of the N antennas comprises a first end part and a second end part, the first end part is opposite to the second end part, a first grounding part of the N grounding parts is connected to the first end part, a first feeding branch circuit is connected to the first antenna between the first end part and the second end part, a first radiating path is formed between the first feeding branch circuit and the first end part, and a second radiating path is formed between the first feeding branch circuit and the second end part.

15. The terminal device according to claim 13, wherein, for each of the N metal radiating elements, the respective metal radiating element is physically connected to a respective feeding branch circuit at a location of the respective metal radiating element that is between two end parts of the respective metal radiating element.

16. The terminal device according to claim 13, wherein at least two of the N metal radiating elements comprise a first part and a second part, and a major axis of each respective first part is perpendicular to a major axis of the corresponding respective second part.

17. The terminal device according to claim 16, wherein the first part and the second part of each of the at least two of the N metal radiating elements form corners of the terminal device.

* * * * *